US006539917B2

(12) United States Patent
Shaw et al.

(10) Patent No.: US 6,539,917 B2
(45) Date of Patent: Apr. 1, 2003

(54) IDLE AIR BYPASS VALVE ACOUSTIC DIVERTER PASSAGE

(75) Inventors: Christopher Edward Shaw, Canton, MI (US); James T. Dumas, Clinton Township, MI (US); James John Kempf, Canton, MI (US)

(73) Assignee: Visteon Global Technologies, Inc., Dearborn, MI (US)

( * ) Notice: Subject to any disclaimer, the term of this patent is extended or adjusted under 35 U.S.C. 154(b) by 57 days.

(21) Appl. No.: 09/848,494

(22) Filed: May 3, 2001

(65) Prior Publication Data

US 2002/0162532 A1 Nov. 7, 2002

(51) Int. Cl.[7] ..... F02M 3/00
(52) U.S. Cl. ..... 123/339.1; 181/229
(58) Field of Search ..... 123/339.1, 339.23, 123/184.21; 181/229, 253, 272

(56) References Cited

U.S. PATENT DOCUMENTS

| | | | | |
|---|---|---|---|---|
| 5,107,800 A | | 4/1992 | Araki et al. | |
| 5,947,082 A | | 9/1999 | Choi et al. | |
| 6,196,187 B1 | * | 3/2001 | Zubeck et al. | 123/339.1 |

FOREIGN PATENT DOCUMENTS

| | | |
|---|---|---|
| EP | 0 915 249 A1 | 5/1999 |
| JP | 4-353265 | 12/1992 |
| JP | 8-135544 | 5/1996 |

* cited by examiner

*Primary Examiner*—John Kwon
(74) *Attorney, Agent, or Firm*—John E. Kajander

(57) ABSTRACT

An arrangement for reducing noise produced by an engine idle air bypass valve and passage includes positioning an acoustic diverter at the end of the air bypass passage to force the noise away from exterior surfaces of a downstream chamber and toward the internal cavities of the engine such as a cylinder head. The diverter of the present invention reduces noise without causing restriction of air flow through the air bypass passage.

11 Claims, 1 Drawing Sheet

IDLE AIR BYPASS VALVE ACOUSTIC DIVERTER PASSAGE

BACKGROUND OF THE INVENTION

1. Field of the Invention

The present invention relates to an idle air bypass arrangement, and more particularly to an arrangement for reducing noise resulting from air flowing from the idle air bypass passage, or other passage used to provide air at idle conditions.

2. Background Art

Generally, it is known to use an idle air bypass arrangement for internal combustion engines which utilize an air input system having an air inlet duct arranged to direct outside air to a throttle valve assembly for supply to in input manifold. Because the throttle valve is closed when an engine is at idle, such idle air bypass arrangements operate to selectively supply air to the engine when the throttle valve is closed. Typically, an idle air bypass valve is positioned in the induction system to circumvent air around the throttle plate so that air can pass through a narrow channel to the intake manifold at low engine speeds. The resulting high air velocity through the narrow channel produces high-speed air noise which is emitted via a downstream body/cavity/chamber such as the intake manifold or a throttle body spacer. The high-velocity noise, in turn, excites the surfaces of the chamber, which in turn results in radiated noise being generated from the exterior surfaces of the chamber.

In an attempt to reduce such noise, U.S. Pat. No. 5,947,082 to Choi et al. discloses positioning a separate silencer device between an outlet of the idle air bypass valve and the intake manifold. The silencer device is arranged to reduce air velocity flowing from the bypass valve into the intake manifold, thereby reducing noise generated therein.

While such arrangements operate to reduce noise levels, such arrangements require either upgrading of the entire idle air bypass passage effective area or utilization of a larger idle air bypass valve in order to maintain equivalent flow rates through the passage to achieve the associated minimization of noise levels.

Therefore, a need exists for an arrangement capable of reducing noise generated by air flow through an idle air bypass passage without otherwise restricting the flow of air through the passage.

SUMMARY OF THE INVENTION

As such, an object of the present invention is to provide an arrangement capable of reducing intake air noise which does not restrict the flow of air through an idle air bypass passage.

In accordance with this and other objects, a noise reduction arrangement is provided for an idle air bypass passage used to supply air to an engine, the idle air bypass passage having an air inlet for receiving a flow of air from an air intake duct and an air outlet coupled to a manifold on the engine to selectively allow a flow of air to bypass a throttle valve assembly connected to the engine, wherein the noise reduction arrangement includes an acoustic diverter positioned at the idle air bypass passage air outlet and arranged to limit sound waves generated by the air flowing through the bypass passage from traveling directly toward any exterior walls proximate the air outlet.

In accordance with one aspect of the present invention, the acoustic diverter is contoured relative to the flow of air exiting the bypass passage air outlet so as redirect the sound waves to travel toward an inner portion of the engine, such as a cylinder head mounted to the engine. In accordance with other aspects of the invention, the acoustic diverter can be fastened to the bypass passage air outlet or integrally formed as part of the bypass passage air outlet.

In accordance with yet another aspect of the present invention, a method is provided for reducing noise generated by air flowing through an idle air bypass passage used to supply air to an engine, wherein the idle air bypass passage includes an air inlet for receiving a flow of air from an air intake duct and an air outlet coupled to a manifold on the engine to selectively allow a flow of air to bypass a throttle valve assembly connected to the engine, the method including diverting sound waves generated by air exiting the idle air bypass passage air outlet to limit the sound waves from traveling directly toward any exterior walls proximate the air outlet.

With the acoustic diverter of the present invention, noise can be reduced without restricting the air flowing through the idle air bypass passage. In fact, airflow restriction can even be reduced by the present invention.

The above objects and other objects, aspects, features and advantages of the present invention are readily apparent from the following detailed description when taken in connection with the accompanying drawings.

DETAILED DESCRIPTION OF THE PREFERRED EMBODIMENT(S)

Figure 1:
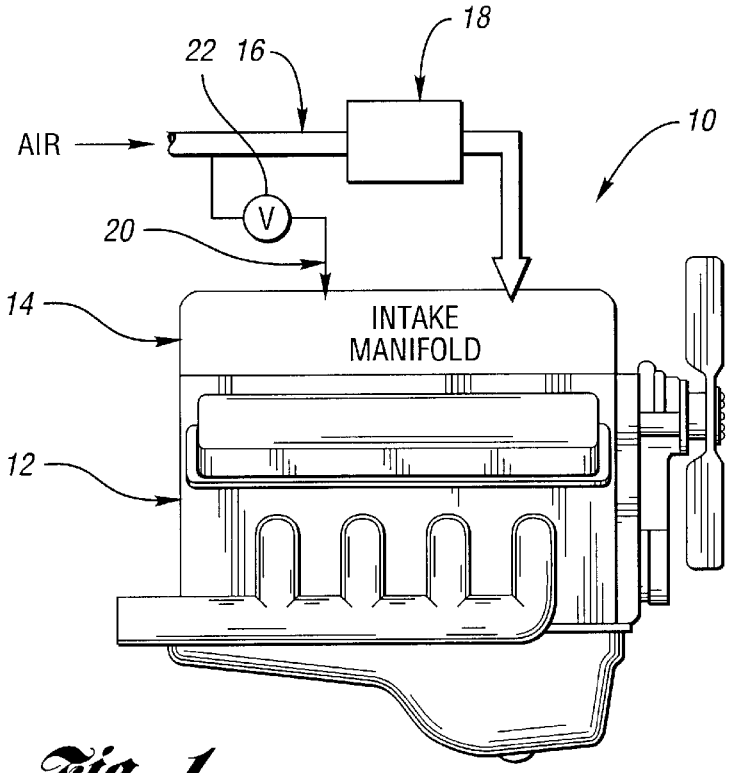
FIG. 1 is a diagrammatic representation of an engine in block form incorporating the idle air bypass valve silencer according to the present invention.

Referring to FIG. 1, an engine 10, such as an internal combustion, is shown having an engine block 12 and an intake manifold 14 mounted thereto. The intake manifold is typically mounted to a cylinder head (not shown). An air inlet duct 16 supplies air to a throttle valve assembly 18 coupled to into manifold 14. As is well known to those skilled in the art, air is metered by the throttle valve assembly to control the operating speed of the engine.

During engine idle, it is common for the throttle valve assembly to be operated to a closed position. As a result, an idle air bypass passage 18 is provided to supply air to the intake manifold when the engine is idling. More specifically, a bypass valve assembly 20 is coupled to the bypass air passage and is opened at engine idle to allow air to flow from inlet duct 16 through the solenoid valve directly into manifold 14, thereby bypassing the closed throttle valve assembly 18. The amount of air allowed to flow through idle air bypass passage provides accurate metering of air at low engine speeds to provide a desired engine speed at engine idle.

As noted above, the air velocity passing through the idle air bypass passage results in high-velocity air noise which is then exited into a surrounding downstream body/cavity/chamber, such as an intake manifold or throttle body spacer. This in turn causes noise to be radiated from an exterior housing surface of the chamber.

In accordance with the present invention, the level of noise is reduced by limiting the manner in which the sound/air exits the idle bypass passage relative to the rest of the downstream chamber. As described below, the sound exiting the idle air bypass passage is redirected toward an inner portion of the engine block/cylinder head and away from direct collision with the walls of the cavity/chamber. As a result, less energy is transmitted to the walls of the chamber body, thereby reducing the level of sound radiating from the exterior walls.

Figure 2:
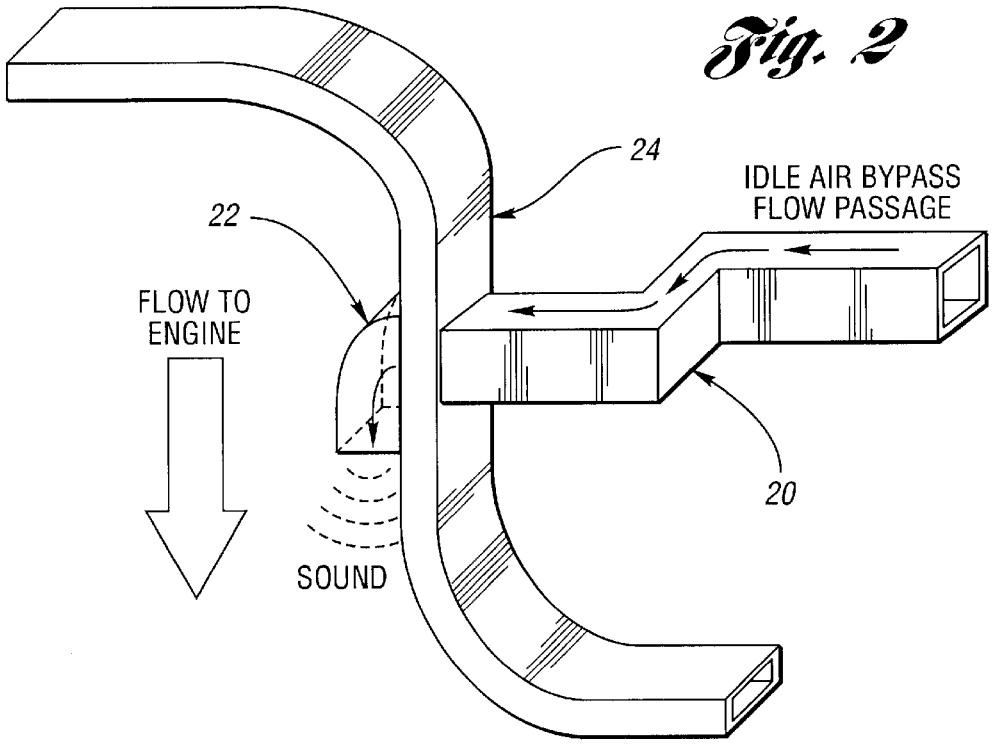
FIG. 2 is a perspective view of the idle air bypass valve acoustic diverter in accordance with the present invention.

Referring now to FIG. 2, an acoustic air diverter 22 is shown in accordance with an exemplary embodiment of the present invention. More specifically, the acoustic diverter is positioned juxtoposely to the exit of idle air bypass flow passage 20 within the surrounding chamber. The diverter can be integrally formed at the end of the air bypass passage 20, or formed as a separate element and attached in any suitable manner to the end of passage 20 or the walls of the chamber surrounding the end of passage 20. The contour or shape of the diverter is a function of the direction of the air flow exiting the bypass passage relative to the surrounding chamber walls. As shown, the diverter can be a curved element that redirects the sound waves at substantially a right angle upon exiting the bypass passage.

The acoustic diverter operates to limit resulting noise generated by the flowing air away from traveling directly toward the walls of the surrounding body. As shown, the airborne sound waves are redirected away from exterior wall(s) 24 of the main body of the intake manifold, which in turn, minimizes vibration of these walls by the airborne noise. By redirecting the airborne noise, the amplitude of the noise incident upon walls 24 is significantly reduced.

Thus, a significant reduction can be achieved in sound pressure levels experienced at a constant position above the main body of the intake manifold. In addition, the reduction in noise levels is advantageously attained without restricting air flow through the idle air bypass passage. As a result, no other alterations are required to offset loss of air flow as required with known arrangements for reducing noise levels. Still further, because the diverter prevents the air flowing out of the idle air bypass passage from directly impinging the air flowing through the main body of the intake manifold, the air passing through the diverter is allowed to blend with air in the main body with less energy loss.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A noise reduction arrangement for an idle air bypass passage used to supply air to an engine, the idle air bypass passage having an air inlet for receiving a flow of air from an air intake duct and an air outlet coupled to a manifold on the engine to selectively allow a flow of air to bypass a throttle valve assembly connected to the engine, wherein the noise reduction arrangement comprises:

an acoustic diverter positioned at the idle air bypass passage air outlet without restricting air flow, and arranged to limit sound waves beyond the outlet as generated by the air flowing through the bypass passage away from traveling directly toward any exterior walls proximate the air outlet.

2. The noise reduction arrangement of claim 1 wherein the acoustic diverter is contoured to direct to the flow of air exiting the bypass passage air outlet so as redirect the sound waves to travel toward an inner portion of the engine.

3. The noise reduction arrangement of claim 2 wherein the inner portion of the engine comprises a cylinder head.

4. The noise reduction arrangement of claim 1 wherein the acoustic diverter is arranged to direct the sound waves to travel toward a cylinder head.

5. The noise reduction arrangement of claim 1 wherein the acoustic diverter is fastened to the air outlet of the bypass passage.

6. The noise reduction arrangement of claim 1 wherein the acoustic diverter is integrally formed as part of the air outlet of the bypass passage.

7. A method for reducing noise generated by air flowing through an idle air bypass passage used to supply air to an engine, the idle air bypass passage having an air inlet for receiving a flow of air from an air intake duct and an air outlet coupled to a manifold on the engine to selectively allow a flow of air to bypass a throttle valve assembly connected to the engine, the method comprising:

diverting sound waves generated by air exiting the idle air bypass passage air outlet without restricting air flow to limit the sound waves beyond the outlet away from traveling directly toward any exterior walls proximate the air outlet.

8. The method of claim 7 wherein diverting the sound comprises positioning an acoustic diverter at the bypass passage air outlet, the acoustic diverter arranged to direct the travel of the sound waves toward an inner portion of the engine.

9. The method of claim 8 wherein directing the travel of the sound waves toward an inner portion of the engine comprises directing the sound waves toward a cylinder head mounted to the engine.

10. The method of claim 8 wherein positioning the acoustic diverter comprises fastening the acoustic diverter to the air outlet of the bypass passage.

11. The method of claim 8 wherein positioning the acoustic diverter comprises integrally forming the acoustic diverter as part of the air outlet of the bypass passage.

* * * * *